United States Patent [19]

Huang et al.

[11] Patent Number: 4,721,552

[45] Date of Patent: Jan. 26, 1988

[54] TWO-STEP METHOD FOR ELECTROLYTICALLY GRAINING LITHOGRAPHIC METAL PLATES

[75] Inventors: Jen-Chi Huang, Mt. Kisco; Daniel Bourgeois, Mahopac, both of N.Y.

[73] Assignee: Polychrome Corporation, Yonkers, N.Y.

[21] Appl. No.: 43,567

[22] Filed: Apr. 27, 1987

[51] Int. Cl.[4] ..... C25F 3/04

[52] U.S. Cl. ..... 204/129.4; 204/129.75

[58] Field of Search ..... 204/33, 129.4, 129.75

[56] References Cited

U.S. PATENT DOCUMENTS

| | | | |
|---|---|---|---|
| 3,935,080 | 1/1976 | Gumbinner et al. | 204/28 |
| 4,072,589 | 2/1978 | Golda et al. | 204/129.4 |
| 4,477,317 | 10/1984 | Chu et al. | 204/33 |
| 4,502,925 | 3/1985 | Walls | 204/33 |
| 4,525,249 | 6/1985 | Arora | 204/129.75 |
| 4,547,275 | 10/1985 | Ejima et al. | 204/129.75 |
| 4,548,683 | 10/1985 | Huang et al. | 204/129.4 |

*Primary Examiner*—John F. Niebling
*Assistant Examiner*—William T. Leader

[57] ABSTRACT

An all electrolytic method for quickly and efficiently producing a well roughened, substantially non-directional, fine honeycomb surface on an aluminum sheet which is characterized by excellent adhesion to coatings and therefore suitable for making lithographic printing plates. The method comprises graining said aluminum sheet with alternating current for less than about 10 seconds in a first aqueous electrolyte solution containing hydrochloric acid, washing and drying the resulting grained aluminum sheet, and then further graining said dried aluminum sheet with alternating current for less than about 10 seconds, preferably 5 to 10 seconds, in a second aqueous electrolyte solution containing nitric acid alone or admixed with hydrochloric acid to obtain the substantially non-directional, fine honeycomb surface on said aluminum sheet.

7 Claims, No Drawings

TWO-STEP METHOD FOR ELECTROLYTICALLY GRAINING LITHOGRAPHIC METAL PLATES

FIELD OF THE INVENTION

The present invention relates to a two-step all electrolytic method for graining metal plates to render them suitable for use as supports for lithographic printing plates. Alternating current is employed in both of the sequential graining steps, which is carried out in the presence of aqueous acidic solutions.

BACKGROUND OF THE INVENTION

There have been many previous proposals for the treatment of aluminum metal sheets or plates to roughen and/or grain their surfaces so that they are more suitable in the manufacture of lithographic printing plates. See for example U.S. Pat. No. 4,477,317 and especially the disclosure in Column 1, which is incorporated herein by reference. As evident from the prior art, the electrolytic treatment has been one of the most popular methods for modifying the surfaces of the aluminum metal so that they can be effectively utilized as lithographic plate supports. Included among the prior art proposals have been various two-step electrolytic treatments.

In recent years the standards for commercially acceptable aluminum metal lithographic supports have become higher. More particularly, it has been found highly desirable to obtain an aluminum metal surface with a fine honeycomb structure that is substantially non-directional. Commercial considerations have also made it important to speed up the graining process operation so that more lithographic plates could be manufactured in a given period of time without incurring the costs that would necessarily result from significant changes in the processing operations or apparatus currently employed. It would be advantageous therefore to have a method for readily producing the fine honeycomb structure on the surface of the aluminum metal plates, while at the same time being able to speed up the production of the aluminum metal lithographic supports without encountering any untoward results.

Heretofore, a substantially non-directional honeycomb topography could be achieved by the method of U.S. Pat. No. 4,548,683 wherein the aluminum metal was immersed in an acidic bath comprising hydrochloric acid, nitric acid or mixtures thereof and utilizing higher frequencies of alternating current than conventionally employed for substantially long treatment times. One major disadvantage of this method is the need for special equipment to produce the requisite high frequencies. The use of nitric acid by itself in a single step, to obtain a proper average roughness of 0.5 to 0.7 μm, has the further disadvantage of being too time consuming involving the use of large amounts of nitric acid, which in turn leads to major waste disposal problems thereby increasing the costs of such an operation. On the other hand, when hydrochloric acid is employed alone in a single step the results are untoward, since the resulting honeycomb structure is always undesirably directional, while at higher current densities no honeycomb was obtained though there was non-directional graining.

SUMMARY OF THE INVENTION

In accordance with the present invention it has been found that a fine honeycomb aluminum metal surface can be achieved by carrying out an all electrolytic treatment utilizing a special two-step method wherein the aluminum metal feed is first subjected to alternating current for less than about 10 seconds in an aqueous solution of hydrochloric acid, and then the aluminum metal is subjected to alternating current for less than about 10 seconds in an aqueous solution of nitric acid. The preferred method also comprises washing the aluminum metal after the first electrolytic treatment with an aqueous alkaline solution and thereafter drying the aluminum metal prior to the second electrolytic treatment.

DETAILED DESCRIPTION OF THE INVENTION

In general, the present invention refers to a method for the electrolytic treatment of aluminum metal plates or sheets in two separate, sequential steps to obtain an aluminum lithographic plate surface having a fine, substantially non-directional topography of proper roughness and adhesiveness.

The starting aluminum metal sheet preferably is aluminum alloy such as No. 1100, No. 3003, No. 1050, No. 3103 or No. 8014 as well as other alloys wherein the aluminum is combined with a small amount of iron, and/or manganese and/or copper metals are also suitable. Although it does not constitute a feature of the present invention, the aluminum metal feed material may be initially roughened or grained by mechanical means such as wire brushing, sand blasting, dry brush graining, or ball graining. If such a procedure is employed, the use of wet mass graining fine, hard abrasive particles, e.g., pumice is preferred.

In the practice of the invention, following conventional degreasing and desmutting pretreatments, the first electrolytic treatment comprises immersing the aluminum sheet in a first aqueous acidic solution containing from about 0.5 to 10%, preferably 1 to 2%, by weight of hydrochloric acid. The aqueous acidic solution or electrolytic bath is maintained at a temperature of at least about 25° C., preferably from about 30° to 60° C. An alternating current of from about 15 to 100 amps per square decimeter, and preferably from about 15 to 80 amps per square decimeter, is applied. This first electrolytic treatment is carried out for less than about 10 seconds; the preferred treatment time period ranging from about 5 to 10 seconds.

The thus treated aluminum metal sheet is next etched and desmutted with an alkaline solution in accordance with conventional etching/desmutting procedures in this art. For most purposes the alkaline solution will comprise a 5% sodium hydroxide solution, and the treatment will be carried out at 50° C. for 20 seconds to achieve etching. In a second step, the aluminum metal sheet is contacted with a 5% sodium bisulfate aqueous solution at 40° C. for 60 seconds, rinsed with water, preferably cold water, and then dried.

Then the dried aluminum metal sheet is subjected to a second electrolytic treatment, which comprises immersing the aluminum sheet in a second aqueous acidic solution containing from about 0.5 to 10%, preferably from about 1 to 2%, by weight of nitric acid. This second aqueous acidic solution or electrolytic bath is maintained at a temperature of at least about 25° C., preferably from about 30° to 50° C. An alternating current with a density of from about 15 to 80 amps per square decimeter, and preferably from about 30 to 60 amps per square decimeter, is applied. This second electrolytic treatment is carried out for 10 seconds or less; the preferred treatment time period ranging from about 5 to 10 seconds.

In some instances it may be desirable to desmut the grained aluminum metal sheet obtained from the second electrolytic treatment step. The same procedure described above can be utilized in this optional step.

In order to produce presensitized lithographic printing plates from the electrolytically grained aluminum sheets of the present invention, the aluminum sheets are coated with a lithographically-suitable photosensitive coating as disclosed in U.S. Pat. Nos. 3,046,120 and 3,181,461. Moreover, an interlayer may also be employed to bond and release a crosslinked and/or photodecomposable photosensitive coating from the aluminum metal surface. See, for example, U.S. Pat. No. 2,714,066.

The invention will be more fully understood by reference to the following illustrative embodiments:

EXAMPLE 1

A sheet of 1050 aluminum alloy was degreased with a conventional alkaline degreasing solution, desmutted with an acidic solution such as sodium bisulfate or nitric acid, and then immersed in an aqueous solution containing 1% w/w hydrochloric acid that was at 30° C. Alternating current was applied to the aluminum plate, now an electrode, and a counter-electrode made of graphite or another similar aluminum plate could also be employed at a gap distance of about 2.5 cm. A current density of 80 A/dm$^2$ was applied for 10 seconds. The plate was next etched in an alkaline solution, desmutted in an acidic solution, rinsed with water and dried.

The dried aluminum plate was re-immersed in a second aqueous electrolyte solution composed of 1% w/w nitric acid at 30° C. It was subjected to alternating current at a current density of 50 A/dm$^2$ for about 10 seconds. Next the plate was etched in a 5% w/w solution of sodium hydroxide at 50° C. for 10 seconds followed by desmutting in 5% sodium bisulfate at 40° C. for 60 seconds.

EXAMPLE 2

The same procedure as Example 1 was carried out except that a mixture of mineral acids (0.33% hydrochloric acid plus 0.66% nitric acid w/w) was used in the second electrolytic treatment step.

The aluminum metal sheets obtained in Examples 1 and 2 were characterized by an overall roughening to give an Ra of 0.50 to 0.70 μm which is highly desirable for long press life, and a fine honeycomb structure, which enhances image adhesion and resolution of the polymer coating to the aluminum supporting plate.

It will be further understood that various changes and modifications can be made in the method of the present invention without departing from the broader scope thereof. The basic plate roughness and topographical appearance can be altered by variations in current density, residence times in the electrolytic solutions as well as electrolytic concentrations and temperatures.

What is claimed is:

1. A method of electrolytically graining an aluminum sheet suitable for use as a lithographic plate to obtain a substantially non-directional honeycomb topography which comprises the following sequential steps:

(a) immersing the aluminum sheet in a first aqueous electrolyte solution consisting of from 0.5 to 10% by weight of hydrochloric acid and then applying an alternating current of from 5 to 100 amps per square decimeter for less than about 10 seconds at a temperature of from 25° to 60° C.;

(b) washing the electrolytically treated aluminum sheet obtained from step (a) with an alkaline solution, then with water, followed by drying; and (c) immersing the dried, electrolytically grained aluminum sheet in a second aqueous electrolytic solution comprising of from 0.5 to 10% by weight of nitric acid and then applying an alternating current of from 5 to 100 amps per square decimeter for less than about 10 seconds at temperature of from 25° to 60° C. to obtain an electrolytically grained aluminum sheet with a surface having a substantially non-directional honeycomb topography.

2. The method of claim 1 wherein the electrolytically grained aluminum sheet obtained from step (c) is washed with an alkaline solution, washed with water, followed by drying.

3. The method of claim 1 wherein said first aqueous electrolyte solution utilizes an alternating current of from 15 to 80 amps per square decimeter.

4. The method of claim 1 wherein the alternating current in the first electrolyte solution is applied for from about 5 to 10 seconds.

5. The method of claim 1 wherein the alternating current in the second electrolyte solution is applied for from about 5 to 10 seconds.

6. The method of claim 1 wherein said second aqueous electrolyte solution utilizes an alternating current of from 15 to 80 amps per square decimeter.

7. The method of claim 1 wherein said second aqueous electrolytic solution comprises an admixture of nitric and hydrochloric acids.

* * * * *